US011668475B2

(12) United States Patent
Hirsch et al.

(10) Patent No.: US 11,668,475 B2
(45) **Date of Patent: *Jun. 6, 2023**

(54) INDUCTION DISPLACEMENT UNIT

(71) Applicant: Air Distribution Technologies IP, LLC, Milwaukee, WI (US)

(72) Inventors: Joachim Hirsch, Colleyville, TX (US); Meghna Parikh, Frisco, TX (US); Brian J. Graham, Grand Prairie, TX (US)

(73) Assignee: Air Distribution Technologies IP, LLC, Milwaukee, WI (US)

( * ) Notice: Subject to any disclaimer, the term of this patent is extended or adjusted under 35 U.S.C. 154(b) by 787 days.

This patent is subject to a terminal disclaimer.

(21) Appl. No.: 16/140,256

(22) Filed: Sep. 24, 2018

(65) Prior Publication Data

US 2019/0086104 A1 Mar. 21, 2019

Related U.S. Application Data

(63) Continuation of application No. 14/211,179, filed on Mar. 14, 2014, now Pat. No. 10,088,179, which is a (Continued)

(51) Int. Cl.

| | |
|---|---|
| ***F24F 3/08*** | (2006.01) |
| ***F24F 1/01*** | (2011.01) |
| ***F24D 5/04*** | (2006.01) |

(52) U.S. Cl.

CPC ..... *F24F 3/08* (2013.01); *F24D 5/04* (2013.01); *F24F 1/01* (2013.01); *F24D 2200/08* (2013.01)

(58) Field of Classification Search

CPC ..... F24F 3/08; F24F 3/02; F24F 3/065; F24F 1/01; F24F 1/014; F24F 1/0063;

(Continued)

(56) References Cited

U.S. PATENT DOCUMENTS 1,902,818 A 3/1933 Anderson
2,914,648 A * 11/1959 Allander ..... F24F 1/01 392/360

(Continued)

OTHER PUBLICATIONS

Canadian Patent Office; Office Action; Canadian Serial No. 2,844,001; dated Apr. 30, 2015.

(Continued)

*Primary Examiner* — Travis Ruby
(74) *Attorney, Agent, or Firm* — Fletcher Yoder, PC

(57) ABSTRACT

An induction displacement unit comprising an induction plenum comprising a plurality of first nozzles communicating with a first discharge plenum and a plurality of second nozzles communicating with a second discharge plenum, a return air plenum, a heating coil disposed between the return air plenum and the first discharge plenum, a cooling coil disposed between the return air plenum and the second discharge plenum, the induction plenum vertically disposed between the heating coil and the cooling coil, the heating coil disposed in an upper portion of the unit, the first discharge plenum disposed to induce a substantially vertical discharge, and the second discharge plenum disposed to induce a substantially horizontal discharge.

25 Claims, 6 Drawing Sheets

Related U.S. Application Data continuation of application No. 13/771,199, filed on Feb. 20, 2013, now Pat. No. 9,625,166.

(58) Field of Classification Search

CPC .... F24F 2001/007; F24F 11/027; F24F 13/26; F24F 2003/005; F24F 9/00; F24F 11/84; F24F 2013/207; F24F 2013/0612; F24F 2013/26; F24D 5/00; F24D 5/04; F24D 5/0085; F24D 2200/08

See application file for complete search history.

(56) References Cited

U.S. PATENT DOCUMENTS 2,921,514 A * 1/1960 Persson ..... F24F 13/26 454/263
2,932,956 A * 4/1960 Chieregatti ..... F24F 11/74 62/296
2,963,225 A * 12/1960 Shelton ..... F24D 5/04 237/2 R
3,012,759 A * 12/1961 Klarer ..... F24F 1/01 62/285
3,012,760 A * 12/1961 McGrath ..... F24F 13/26 165/109.1
3,032,323 A 5/1962 Church
3,092,178 A * 6/1963 Birdsall ..... F24F 13/26 165/129
3,100,078 A * 8/1963 Dreibelbis ..... F24F 1/00077 236/47
3,120,344 A * 2/1964 Wood ..... F24F 1/01 236/1 C
3,165,263 A * 1/1965 Dreibelbis ..... F24F 11/83 236/100
3,208,508 A * 9/1965 Bryans ..... F24F 3/06 165/213
3,211,218 A * 10/1965 Mehr ..... F24F 1/01 165/123
3,232,342 A * 2/1966 Boysen ..... F24F 11/81 165/123
3,323,584 A 6/1967 Serratto
3,332,475 A * 7/1967 Selhost ..... F24F 11/81 165/249
3,378,062 A * 4/1968 Ringquist ..... F25B 29/003 165/221
3,406,744 A * 10/1968 Scheibler ..... F24F 3/08 165/221
3,452,811 A * 7/1969 Honnold, Jr. ..... F24F 11/81 165/103
3,454,079 A * 7/1969 Japhet ..... F24F 1/01 165/279
3,455,378 A * 7/1969 Honnold, Jr. ..... F24F 1/01 165/135
3,470,945 A * 10/1969 Schmidt ..... F24F 11/74 165/103
3,512,578 A * 5/1970 Winfried ..... F24F 1/01 165/122
3,623,542 A * 11/1971 Fragnito ..... B60H 1/00485 165/299
3,635,245 A * 1/1972 Canfield ..... F24F 3/00 137/607
3,841,392 A * 10/1974 Osheroff ..... F15C 1/008 165/214
3,841,398 A * 10/1974 Serratto ..... F24F 1/01 165/123
3,853,173 A 12/1974 Osheroff
3,877,513 A 4/1975 Arledge, Jr.
3,994,335 A 11/1976 Perkins
4,031,951 A 6/1977 Engler
4,100,964 A * 7/1978 Gorchev ..... B60H 1/00007 165/123
4,657,178 A * 4/1987 Meckler ..... F24F 1/01 236/13
4,958,500 A * 9/1990 Kuroda ..... F24F 1/0033 62/263
5,005,636 A 4/1991 Haessig
5,187,949 A * 2/1993 Jung-Il ..... F24F 1/005 62/411
5,377,503 A * 1/1995 Reedy ..... F24F 1/0014 165/137
6,213,867 B1 * 4/2001 Yazici ..... F24F 1/01 454/261
6,715,538 B2 * 4/2004 Horttanainen ..... F24F 1/01 165/96
6,834,714 B2 * 12/2004 Walsh ..... G05D 23/1393 165/220
7,013,969 B1 3/2006 Loudermilk
2002/0062948 A1 * 5/2002 Horttanainen ..... F24F 1/01 165/123
2002/0070010 A1 * 6/2002 Hakkinen ..... F24F 1/0059 165/123
2007/0164124 A1 * 7/2007 Juslin ..... F24F 11/81 237/50
2009/0095007 A1 * 4/2009 Ohmae ..... F24F 1/0057 62/259.1
2009/0199583 A1 * 8/2009 Jeon ..... F24F 1/0057 62/259.1
2009/0264062 A1 10/2009 Miller et al.
2010/0140363 A1 6/2010 Hirsch et al.
2010/0270385 A1 * 10/2010 Kim ..... G05D 23/1934 237/81
2011/0039491 A1 2/2011 Khalifa et al.
2011/0174475 A1 7/2011 Tangney
2011/0308266 A1 * 12/2011 Lafleur ..... F24F 1/0014 62/186
2012/0015600 A1 * 1/2012 Larsson ..... F24F 13/26 454/254
2012/0088445 A1 4/2012 Hirsch
2012/0270494 A1 10/2012 McCarthy
2013/0240172 A1 * 9/2013 Reilly ..... F24F 11/83 165/11.1

OTHER PUBLICATIONS

Canadian Patent Office; Response to Office Action; Canadian Serial No. 2,844,001; dated Jun. 16, 2015.

The Notice of Allowance issued by the Canadian Patent Office for Canadian Serial No. 2,844,001 dated May 30, 2016.

* cited by examiner

INDUCTION DISPLACEMENT UNIT

CROSS REFERENCE TO RELATED APPLICATIONS

This application is a continuation of U.S. patent application Ser. No. 14/211,179, entitled "INDUCTION DISPLACEMENT UNIT," filed Mar. 14, 2014, now U.S. Pat. No. 10,088,179, which issued on Oct. 2, 2018, which is a continuation of U.S. patent application Ser. No. 13/771,199, entitled "INDUCTION DISPLACEMENT AIR HANDLING UNIT," filed Feb. 20, 2013, now U.S. Pat. No. 9,625,166, which issued on Apr. 18, 2017, each of which is hereby incorporated by reference in its entirety for all purposes.

FIELD OF THE INVENTION

The invention relates to an induction displacement unit, and more particularly, to an induction displacement unit comprising an induction plenum communicating with a first discharge plenum and a second discharge plenum, the first discharge plenum in communication with a heating coil and the second discharge plenum in communication with a cooling coil.

BACKGROUND OF THE INVENTION

Displacement ventilation systems are in wide spread use in the HVAC industry. One particular application for such systems is in educational buildings. Typically, a number of displacement air terminal devices will be located along a perimeter wall of a classroom space and are configured to deliver ventilation air to the space, see FIG. 1.

Displacement ventilation (DV) is an air distribution system designed to simultaneously improve indoor air quality and reduce energy use. Cool, rather than cold supply air is provided directly to occupants through low mounted diffusers. Heat generated by the occupants and equipment in the space causes ventilation air to be naturally drawn up by convection which ensures fresh air is continually delivered to the breathing zone of the occupants. The warm air continues to rise and contaminants are carried away towards the ceiling exhaust, resulting in improved indoor air quality near the occupants. Schools, restaurants, theaters, atria, other open spaces with high ceilings, and spaces where air quality is a concern are excellent applications.

In addition to the displacement function, it is also known to configure displacement devices to have induction nozzles. By adding induction, room air from the space can be conditioned, filtered, and returned to the space in a mixture with the ventilation air. This type of unit is sometimes referred to as an induction-displacement unit. In this type of system, a coil is provided in the return air path of the induction-displacement unit to condition the return air, as necessary. In the cooling mode, the coil will reduce the return air temperature to a few degrees below the space temperature. In the heating mode, the coil may be set to raise the temperature of the return air such that the delivered air has a higher temperature than that of the air in the room.

In each mode a space temperature set point can be maintained, however, in heating mode, the induction-displacement unit can no longer function as a displacement terminal unit due to the fact that the delivered air starts rising as soon as it leaves the unit instead of pooling across the floor. To prevent placing an induction-displacement unit in the heating mode, a separate heating system can be provided in the space, such as fin-tube radiation or radiant panels. However, as the induction-displacement units are placed along at least one wall of the space, such heating systems cannot be placed in the same location. This is especially troublesome where the induction-displacement units are located along an exterior wall of the space because this is the location where heating is generally most needed. As such, improvements are desired for induction-displacement units that can simultaneously provide heating to an exterior wall of a space and provide displacement ventilation air to the occupied area of the space.

Representative of the art is U.S. Publication No. 2012/0270494 which discloses an induction-displacement neutral wall air terminal unit includes a housing defining a supply airflow path, a connected return airflow path, and a heating airflow path separated from the supply and return airflow paths by at least one interior wall. The unit also includes a plurality of induction-type nozzles located within the supply airflow path, that are deliver a ventilation air flow stream into the supply air flow path. The nozzles induce a return air flow stream through the return air flow path that mixes with the ventilation air flow stream to form a supply air flow stream delivered to a supply air outlet. A heating element is disposed within the heating airflow path to heat air within the heating air flow path. A plurality of fans may be placed within the heating airflow path to increase the overall heating capacity of the unit.

What is needed is an induction displacement unit comprising an induction plenum communicating with a first discharge plenum and a second discharge plenum, the first discharge plenum in communication with a heating coil and the second discharge plenum in communication with a cooling coil. The present invention meets this need.

SUMMARY OF THE INVENTION

The primary aspect of the invention is to provide an induction displacement unit comprising an induction plenum communicating with a first discharge plenum and a second discharge plenum, the first discharge plenum in communication with a heating coil and the second discharge plenum in communication with a cooling coil.

Other aspects of the invention will be pointed out or made obvious by the following description of the invention and the accompanying drawings.

The invention comprises an induction displacement unit comprising an induction plenum comprising a plurality of first nozzles communicating with a first discharge plenum and a plurality of second nozzles communicating with a second discharge plenum, a return air plenum, a heating coil disposed between the return air plenum and the first discharge plenum, a cooling coil disposed between the return air plenum and the second discharge plenum, the induction plenum vertically disposed between the heating coil and the cooling coil, the heating coil disposed in an upper portion of the unit, the first discharge plenum disposed to induce a substantially vertical discharge, and the second discharge plenum disposed to induce a substantially horizontal discharge.

BRIEF DESCRIPTION OF THE DRAWINGS

The accompanying drawings, which are incorporated in and form a part of the specification, illustrate preferred embodiments of the present invention, and together with a description, serve to explain the principles of the invention.

DETAILED DESCRIPTION OF THE PREFERRED EMBODIMENT

Figure 1:
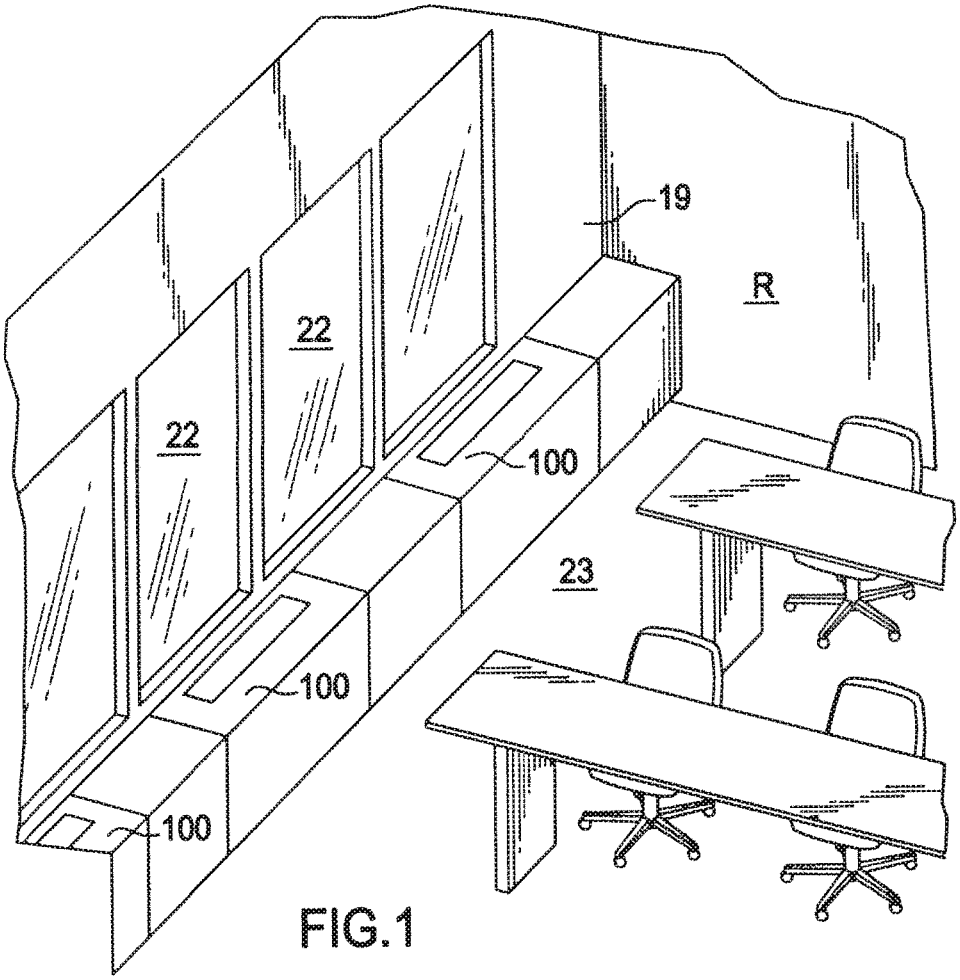
FIG. 1 is a perspective view of a conditioned space with two inventive units.

FIG. 1 is a perspective view of a conditioned space such as a classroom with two inventive units. Units 100 are typically installed along an exterior wall. The wall displacement unit can be utilized in building air-conditioning systems with air handlers, chilled water circuits, and hot water boiler systems.

Figure 2:
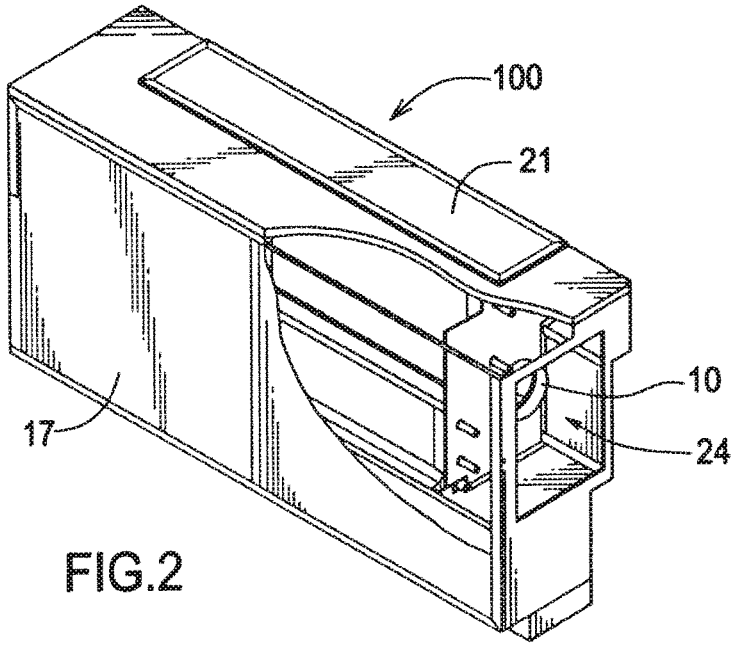
FIG. 2 is a perspective cut-away view of an inventive unit.

FIG. 2 is a perspective cut-away view of an inventive unit. Each inventive wall displacement unit 100 receives a constant volume of pressurized prime air flow comprising conditioned outside air at supply air temperatures, typically in the range of approximately 50° F. to 70° F., through the prime air inlet opening 10. The prime air is pressurized as it enters the unit.

Figure 3:
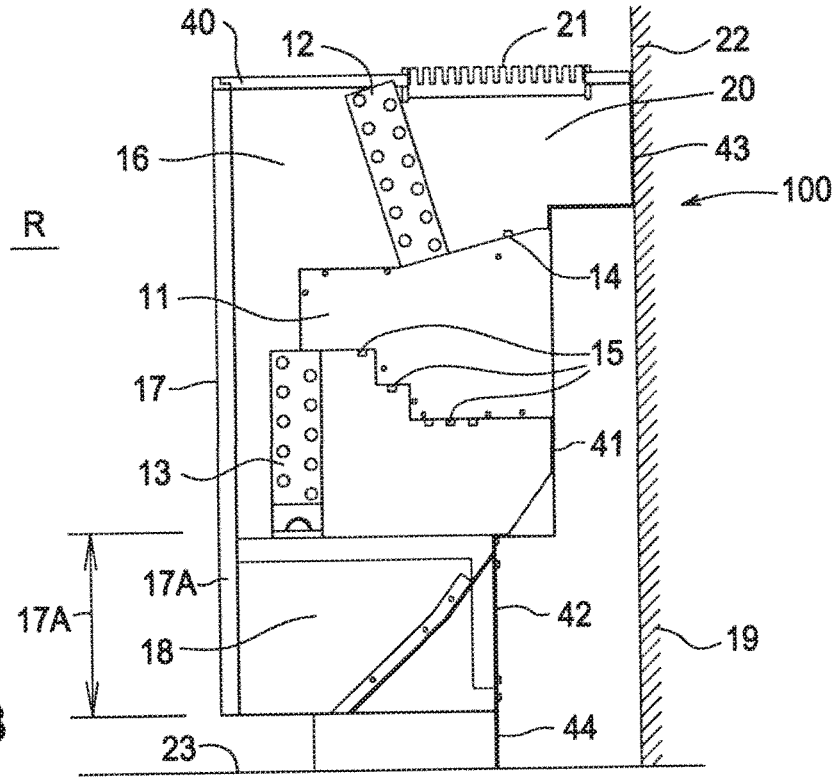
FIG. 3 is a cross-sectional view of an inventive unit.

FIG. 3 is a cross-sectional view of an inventive wall displacement unit. The unit housing comprises a top 40 to which grille 21 is mounted. Panels 41, 42, 43, 44 typically comprise the side of the unit adjacent the wall 19. Side panels 45, 46 complete the unit.

Wall displacement unit 100 comprises an induction plenum 11 and a coil for air heating 12 and a coil for air cooling 13. Induction plenum 11 is vertically disposed between the heating coil 12 and the cooling coil 13 in a stacked arrangement. Heating coil 12 is vertically disposed in an upper portion of the unit while the cooling coil 13 is disposed below the elevation of the heating coil 12. This vertical configuration takes advantage of the buoyant (lower density) nature of warmer air when compared to cooler air. Induction plenum 11 further comprises a plurality of air injection nozzles 14, 15 in communication with discharge plenum 20 and discharge plenum 18 respectively.

Air from the induction plenum 11 flows through nozzles 14, 15 thereby inducing a return flow of room air from the conditioned room (R) into the return air plenum 16. A portion of the returned room air flows through cooling coil 13 thereby reconditioning the return room air prior to mixing with the primary air jets in the lower discharge plenum 18. The return air is then discharged at low velocity as supply air through the lower part of the perforated front cover, 17 and 17A, in a substantially horizontal direction when in cooling mode operation.

In heating mode operation, the supply air discharged through the lower part of the front cover 17, see 17A, delivers prime ventilation air at near room temperature. The main source for heat load neutralization of a cold outside wall or window 19 is the upper heating coil 12. The returned room air flows through heating coil 12 to recondition the room air prior to discharge through grille 21. The reconditioned room air is then mixed with the primary air jets from nozzles 14 in the upper discharge plenum 20. Nozzles 14 discharge in a generally upward direction. Nozzles 15 discharge in a generally downward direction. Discharge plenum 20 is in an upper portion of the unit so as to facilitate an upward or substantially vertical air flow.

Heating coil 12, disposed in an uppermost portion of the unit, heats the air and when mixed with the air flow from nozzles 14 elevates the temperature of the return air entering the coil from the return plenum 16, thereby causing forced convection. Heated air is discharged upward through the grill 21 on top of the unit. Upon exiting grille 21 the heated air rises along the perimeter wall 19 and window 22 to create a building heating load neutralizing warm air curtain.

Each unit can be sized to fit under a sill adjacent to the perimeter wall 19 mounted to the floor 23 or wall 19. The unit provides spacing for connecting hardware 24 on both sides of the unit inside the housing. Although the unit is designed for use in new buildings, it can also be used for refurbishing existing high-pressure induction systems.

Figure 4:
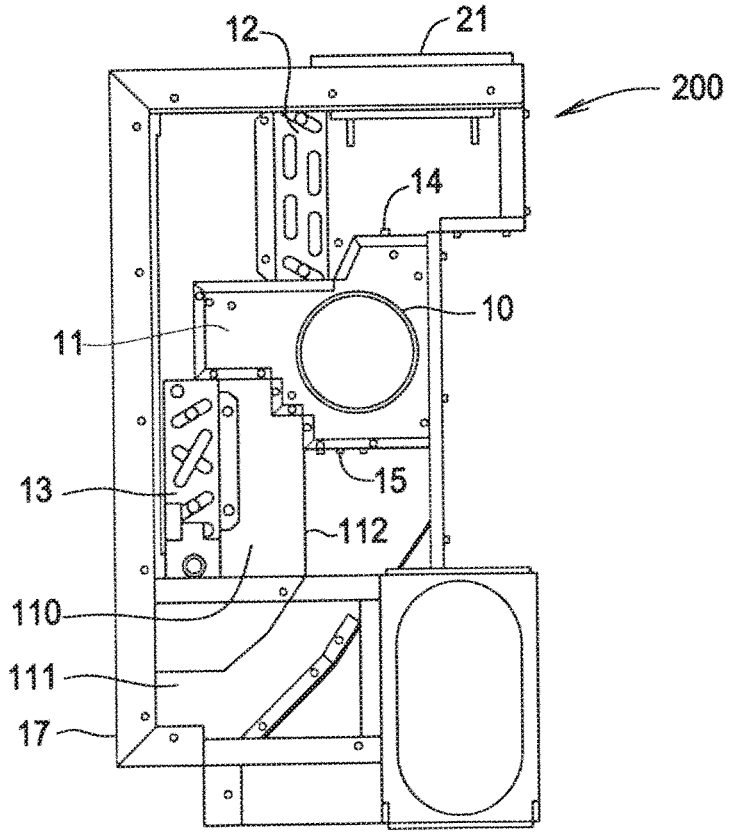
FIG. 4 is a cross-sectional view of an alternate embodiment of the inventive unit.

FIG. 4 is a cross-sectional view of an alternate embodiment of the inventive unit. In this alternate embodiment induction plenum 11 of unit 200 receives a constant volume of pressurized prime air flow of conditioned outside air at supply air temperatures, typically approximately 50° F. to 70° F., through the prime air inlet opening 10. Unit 200 comprises an induction plenum 11 and separate coils 13 for cooling. The cooling supply air stream is separated into two distinctive plenum sections, a main lower discharge plenum 110 and a secondary lower discharge plenum 111. Plenums 110 and 111 are separated by wall member 112. Plenum section 110 provides a high induced flow and plenum section 111 adds required ventilation air to the induced flow. Both flows exit the unit in a substantially horizontal direction.

Figure 5A:
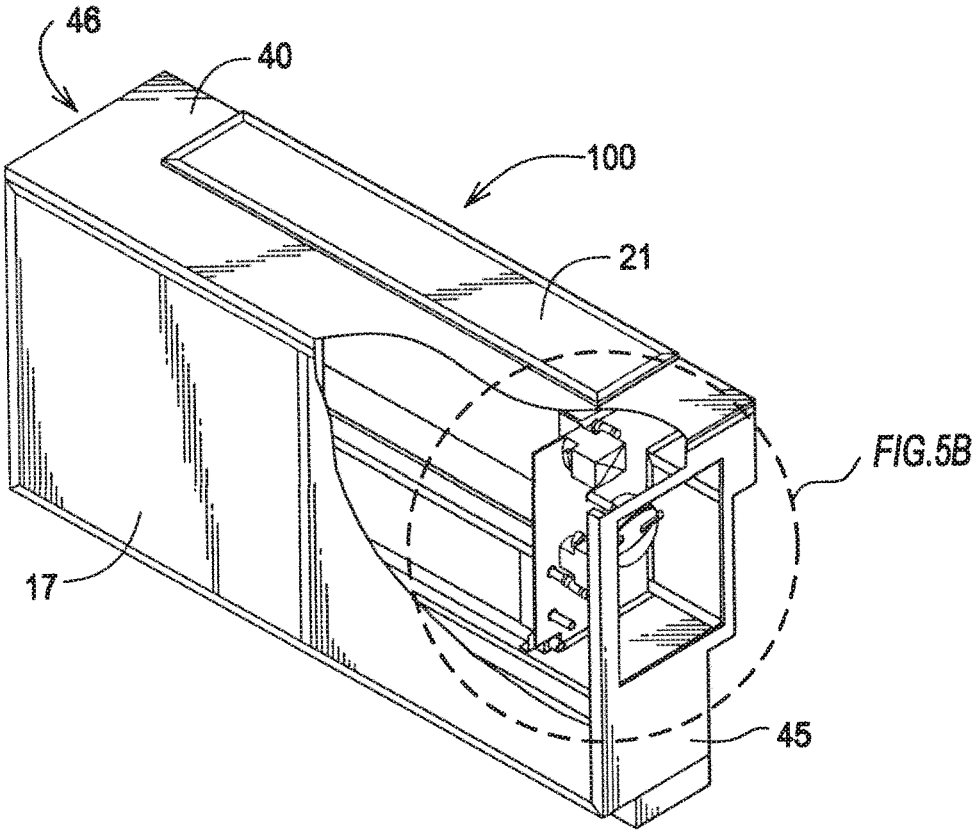
FIG. 5A is a perspective cut-away view of the inventive unit.
Figure 5B:
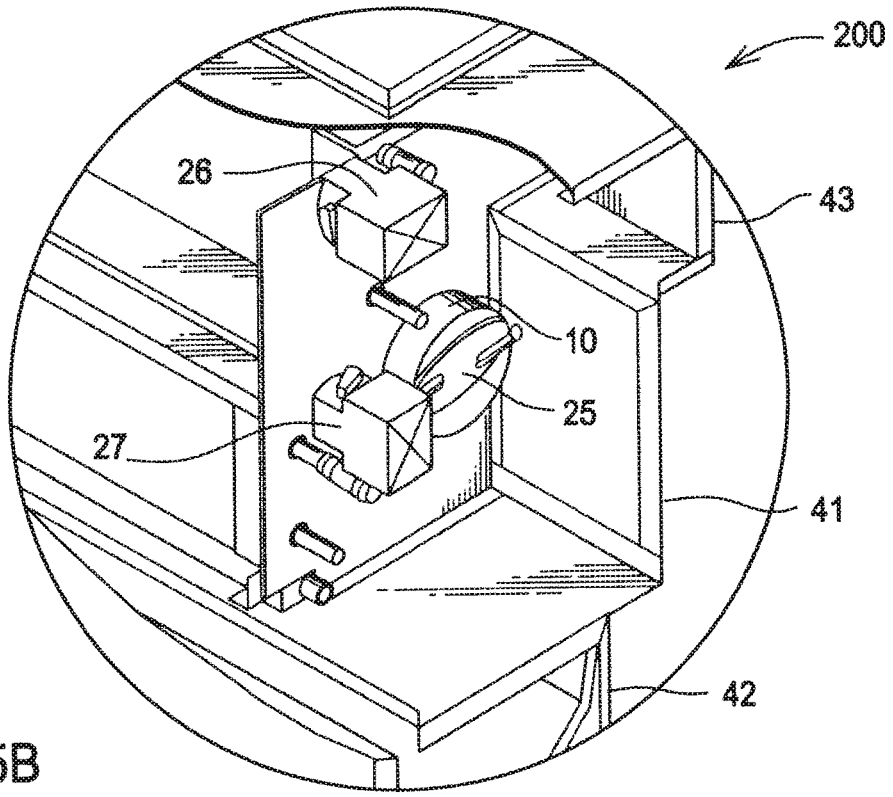
FIG. 5B is a detail of FIG. 5A.

FIG. 5A is a perspective cut-away view of the inventive unit. Unit 100 receives a constant volume of pressurized prime air flow of conditioned ventilation air at prime air temperatures, typically in the range of approximately 50° F. to 70° F., through the prime air inlet opening 10. Unit 100 is equipped with air damper 25 to control the ventilation air volume. In FIG. 5B, damper 25 is connected to inlet opening 10. Damper 25 operates with the building control system (not shown) and reduces or shuts off the primary air flow to the induction plenum 11 when demand is low, for example, when the building is unoccupied. When demand is reduced it is also possible to operate just one or two units when a partial load is required thereby shutting off other units in the system.

Unit 100 further comprises water control valves 26, 27. Valve 26 controls hot water flow from a boiler (not shown) to the heating coil 12. Valve 27 controls cold water flow from a chiller (not shown) to the cooling coil 13. A thermostat (not shown) in the conditioned space controls the room temperature by controlling operation of the water circuits entering the coils through the water control valves 26, 27. The heating and cooling coils may be controlled by either a two-way water valves 26, 27 or alternatively with three-way water valves.

Figure 6:
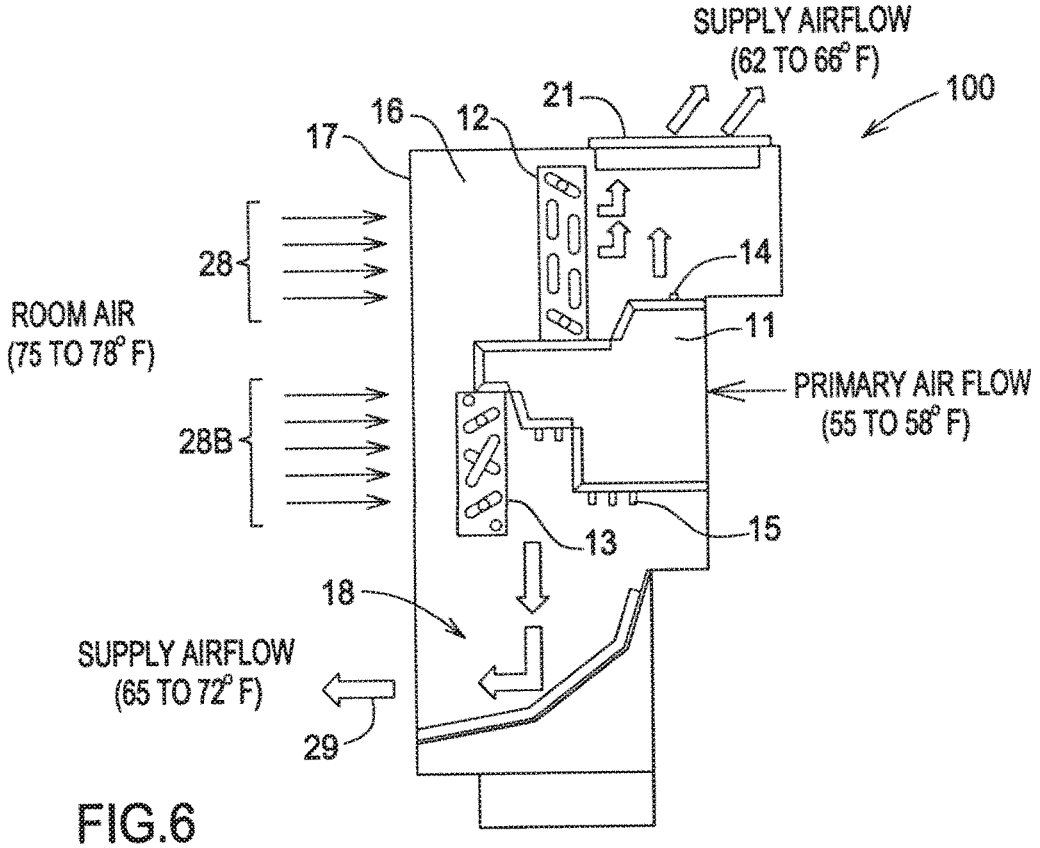
FIG. 6 is a cross-sectional view showing the cooling air flow path.

FIG. 6 is a cross-sectional view showing the cooling air flow path. Room return air 28 enters the upper part of the housing, thereby entering the return air plenum 16. In this example heating coil 12 is shutoff because it does not operate during a cooling season. Induction nozzles 14, 15 located on the induction plenum 11 are pressurized by prime air at approximately 0.25" to 1.0" w.g and a temperature in the range of approximately 55° F. to 58° F. Discharge of the positive pressure air through the nozzles 15 induces a flow of return air 28B through cooling coil 13. Conditioned return air leaving cooling coil 13 at approximately 68° F. mixes with the prime air at approximately 55° F. in the discharge plenum 18. The prime air entering the induction plenum 11 is conditioned by an outdoor air handler known in the art (not shown). Mixed air (65° F.) 29 is discharged through the lower discharge plenum 18 into the room in a substantially horizontal direction 29.

In this embodiment the inlet air flow is received into the unit through the front of the unit 17. A portion of the inlet flow is diverted through the heating coil 12 and a portion through the cooling coil 13. In particular, since heating coil 12 and cooling coil 13 are immediately adjacent the induction plenum the primary air discharged from the induction plenum 11 through nozzles 14, 15 is efficiently used to induce an air flow for both heating 31 through heating coil 12 and for cooling 29 through cooling coil 13. This configuration does not require fans to move the air through the unit.

Figure 7:
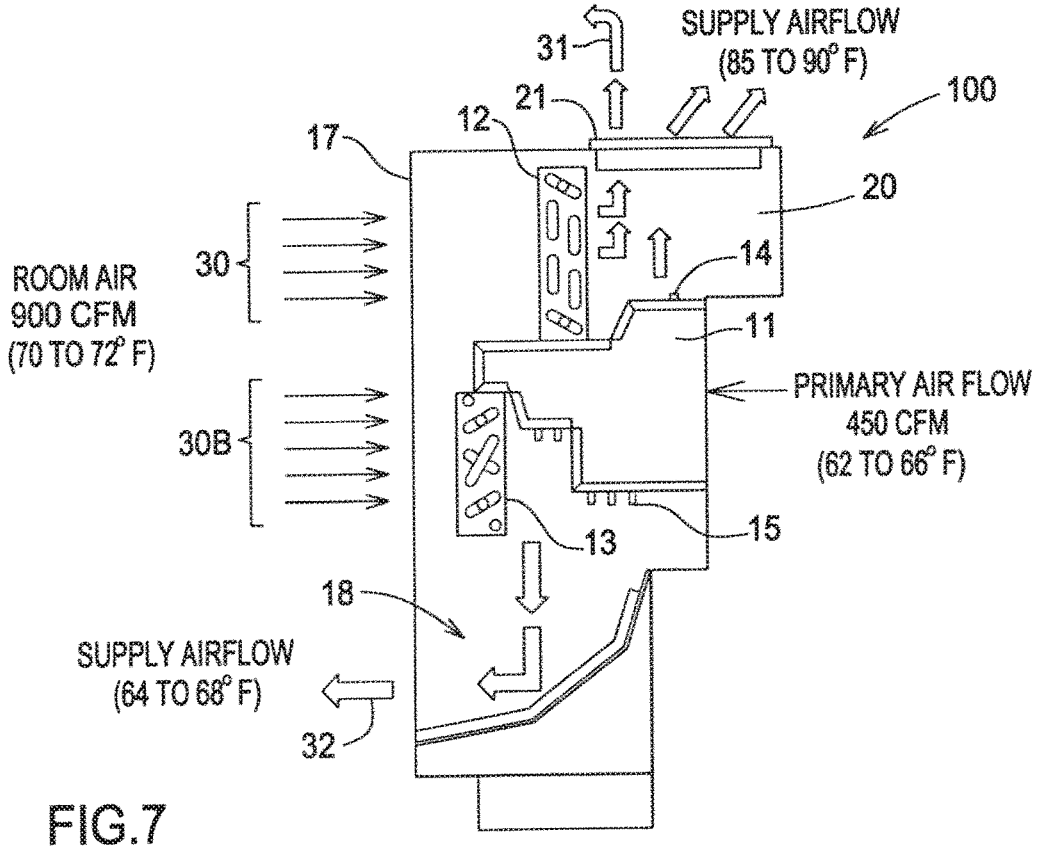
FIG. 7 is a cross-sectional view showing the heating air flow path.

FIG. 7 is a cross-sectional view showing the heating air flow path. Room air 30 at approximately 70° F. to 72° F. enters the upper part of the housing, thereby entering return air plenum 16. Cooling coil 13 is typically shutoff and does not operate during a heating season. Induction nozzles 14, 15 located on the induction plenum 11 are pressurized by prime air at approximately 0.25" to 1.0" w.g. Discharge of the positive pressure prime air through nozzles 14 induces a flow of return air through heating coil 12 which is at a temperature of approximately 120° F. to 180° F. The conditioned air leaves the heating coil at a temperature in the range of approximately 90° F. to 105° F. and thereafter mixes with the conditioned prime air at approximately 65° F. Heating coil 12 may comprise a hydronic or water heating element, a steam heating element, or an electric heating element. The mixed air at a temperature of approximately 85° F. to 90° F. is discharged through the upper discharge plenum 20 through grill 21 into the conditioned room in a substantially vertical direction 31.

The mass flow of the discharged heating supply air can be adjusted by the quantity of nozzles 14 dedicated to heating. The air curtain created by discharge 31 in front of a window or cold wall is configured to roll the air within the adjacent area of the perimeter wall, and not to disturb the stratification created by the displacement ventilation. The mass flow, and therefore the quantity of nozzles 14 dedicated to heating, can be customized to accommodate 120° F., 140° F. and 180° F. water entering from a boiler (not shown).

Cooling coil 13 is not operating during the heating season, but prime air pressurizing at approximately 0.25" to 1.0" w.g. induction nozzles 15 causes the return air 30B to be drawn through the cooling coil 13. Return air leaving the cooling coil, at approximately 72° F., will mix with the conditioned prime air at approximately 65° F. The mixed air 32 at approximately 68° F. is discharged through the lower discharge plenum 18 in a substantially horizontal direction.

The unit provides at least 8,000 btuh of heating through the heating airflow path when the heating coil 12 is served by hot water having a temperature of approximately 180° F. The unit can be configured to operate in a heating mode wherein the heating coil 12 provides heated air through the heating airflow path; and a ventilation mode wherein the unit provides a supply airflow stream having a temperature of about 53° F. The heating mode can be simultaneously activated with a ventilation mode.

The number and diameter of nozzles 14 can be selected based upon the temperature of the water entering the heating coil 12. The numeric values included in this description are not intended to limit the scope of the invention and are provided as examples only.

Assuming a total of 42 nozzles (14), the diameters are:

| Entering Water Temperature [° F.] | Nozzle diameter [inches] |
|---|---|
| 120 | 0.140 |
| 140 | 0.188 |
| 180 | 0.250 |

Assuming a nozzle diameter of 0.188 inches the nozzle quantities are:

| Entering Water Temperature [° F.] | Nozzle quantity |
|---|---|
| 120 | 32 |
| 140 | 42 |
| 180 | 56 |

In operation, the inventive unit creates a simultaneous mixing heating curtain neutralizing cold perimeter loads while utilizing displacement ventilation for the inner occupied space. The inventive induction displacement wall unit also meets the noise requirements of ANSI Standard S12.60, which is advantageous in applications where reduced noise is desirable, such as in school classrooms.

In operation the unit provides a method of conditioning a space using an induction displacement unit. The unit induces a return air flow into the unit by discharging pressurized air within the unit. The return air flow stream comprises a single stream of air entering the unit through the front of the unit. The unit induces a portion of the return air flow stream 28 to flow through a heating coil and induces a portion of the return air flow stream 28B to flow through a cooling coil. The unit discharges the air flow from the heating coil in a substantially vertical direction. The unit discharges the air flow from the cooling coil in a substantially horizontal direction.

Figure 8:
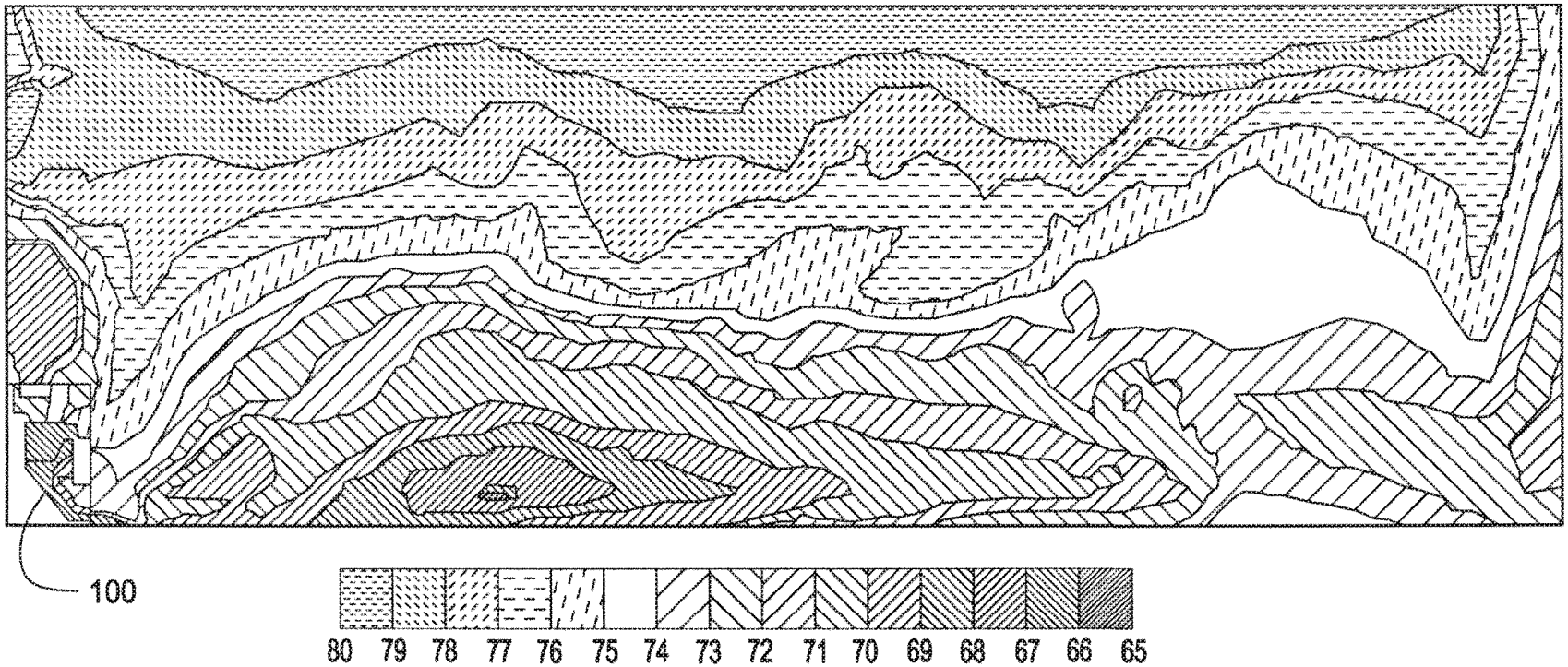
FIG. 8 is a conditioned space temperature profile in heating mode using the inventive unit.

FIG. 8 is a conditioned space temperature profile in heating mode using the inventive unit. The unit provides uniform distribution of conditioned air to the space. The heated air is evenly distributed through the space while cool air is drawn to the unit along the floor.

Figure 9:
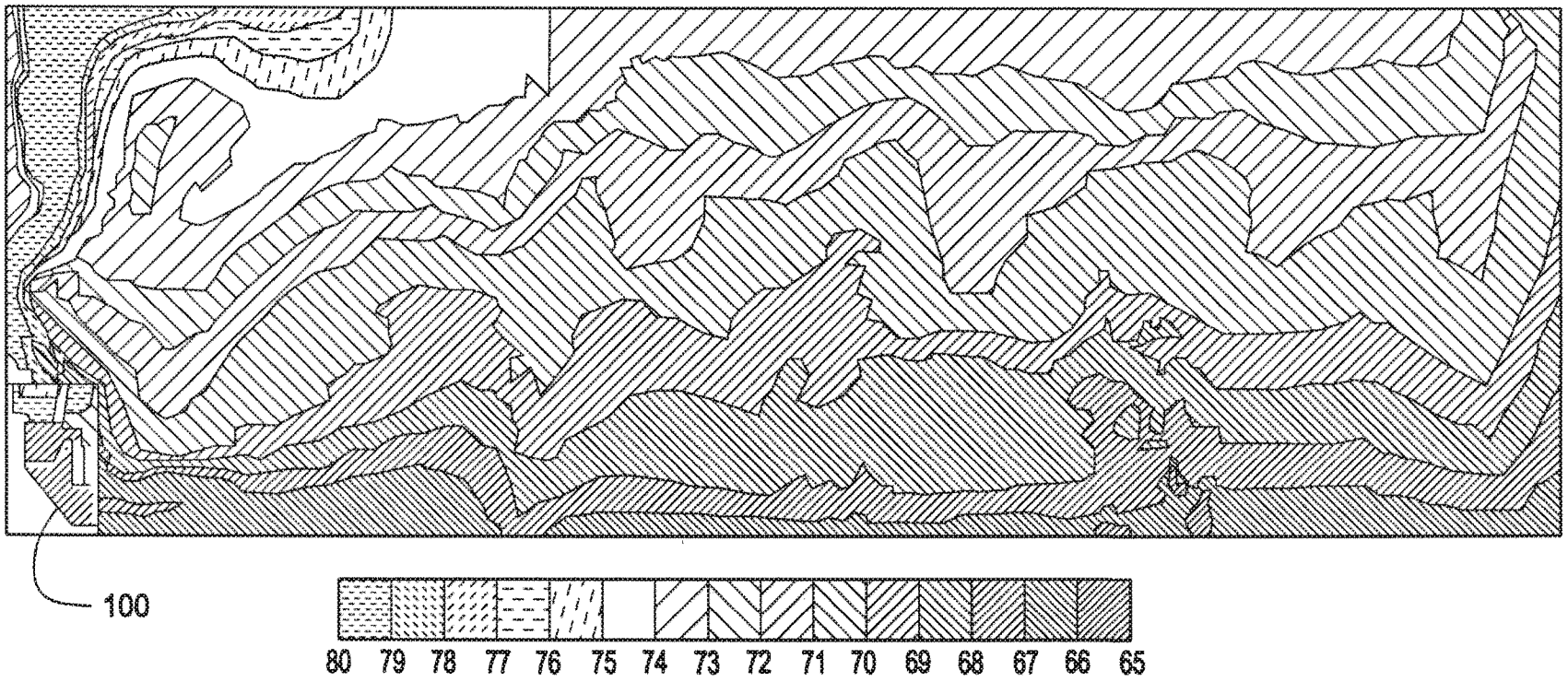
FIG. 9 is a conditioned space temperature profile in cooling mode using the inventive unit.

FIG. 9 is a conditioned space temperature profile in cooling mode using the inventive unit. The unit provides uniform distribution of conditioned air to the space. The chilled air is evenly distributed through the space while hot air is drawn to the unit along the ceiling.

Although a form of the invention has been described herein, it will be obvious to those skilled in the art that variations may be made in the construction and relation of parts without departing from the spirit and scope of the invention described herein.

The invention claimed is:

1. An induction displacement unit, comprising:

an induction plenum configured to discharge pressurized air to a first discharge plenum and a second discharge plenum, wherein the induction plenum includes a first nozzle in communication with the first discharge plenum and a second nozzle in communication with the second discharge plenum;

a return air plenum;

a heating air flow path defined between the return air plenum and the first discharge plenum;

a cooling air flow path defined between the return air plenum and the second discharge plenum;

a heating coil disposed within the heating air flow path; and a cooling coil disposed within the cooling air flow path, wherein the cooling coil is positioned below the heating coil.

2. The induction displacement unit of claim 1, wherein an upstream portion of the heating air flow path overlaps with an upstream portion of the cooling air flow path.

3. The induction displacement unit of claim 1, wherein the cooling coil is configured to cool air flowing along the cooling air flow path during a cooling mode of the induction displacement unit, and wherein the heating coil is configured to heat air flowing along the heating air flow path during a heating mode of the induction displacement unit.

4. The induction displacement unit of claim 1, comprising a controller configured to actuate the heating coil during a heating mode of the induction displacement unit, wherein the heating coil is configured to heat air flowing along the heating air flow path when actuated.

5. The induction displacement unit of claim 4, comprising a water control valve fluidly coupled to the heating coil and communicatively coupled to the controller, wherein the controller is configured to actuate the heating coil by instructing the water control valve to open.

6. The induction displacement unit of claim 1, comprising a controller configured to actuate the cooling coil during a cooling mode of the induction displacement unit, wherein the cooling coil is configured to cool air flowing along the cooling air flow path when actuated.

7. The induction displacement unit of claim 6, comprising a water control valve fluidly coupled to the cooling coil and communicatively coupled to the controller, wherein the controller is configured to actuate the cooling coil by instructing the water control valve to open.

8. The induction displacement unit of claim 1, wherein the heating air flow path and the cooling air flow path are each defined within a housing of the induction displacement unit.

9. The induction displacement unit of claim 8, comprising the housing, wherein the first discharge plenum is directly coupled to a top surface of the housing, and wherein the second discharge plenum is directly coupled to a side surface of the housing.

10. The induction displacement unit of claim 1, wherein the induction plenum is vertically disposed between the heating coil and the cooling coil.

11. The induction displacement unit of claim 10, wherein the heating coil is disposed in an upper portion of the induction displacement unit.

12. The induction displacement unit of claim 1, wherein the first nozzle is configured to induce air flow along the heating air flow path, and wherein the second nozzle is configured to simultaneously induce air flow along the cooling air flow path.

13. The induction displacement unit of claim 1, wherein the induction plenum comprises a single interior piece having an upper surface in contact with the first discharge plenum and in which the first nozzle is disposed, and having a lower surface in contact with the second discharge plenum and in which the second nozzle is disposed.

14. An induction displacement unit, comprising:

an induction plenum in communication with a first discharge plenum and a second discharge plenum;

a return air plenum;

a heating coil disposed along a heating air flow path extending between the return air plenum and the first discharge plenum; and a cooling coil disposed along a cooling air flow path extending between the return air plenum and the second discharge plenum, wherein the cooling coil is positioned below the heating coil, wherein the cooling coil is configured to be actuated during a cooling mode to cool an air flow that is directed along the cooling air flow path, and wherein the second discharge plenum is configured to output a substantially horizontal discharge of the air flow.

15. The induction displacement unit of claim 14, comprising a water control valve configured to adjust a flow rate of cooling water directed through the cooling coil, wherein the cooling coil is configured to be actuated via adjustment of the water control valve during the cooling mode to enable the induction displacement unit to cool the air flow to a target temperature.

16. The induction displacement unit of claim 14, wherein the induction plenum is in communication with the first discharge plenum via a first nozzle, and wherein the induction plenum is in communication with the second discharge plenum via a second nozzle.

17. The induction displacement unit of claim 16, wherein the second nozzle is configured to provide a conditioned primary air flow from the induction plenum to the cooling air flow path to induce the air flow into the induction displacement unit and along the cooling air flow path.

18. The induction displacement unit of claim 14, wherein the heating coil is configured to be actuated during a heating mode to heat an additional air flow that is directed along the heating air flow path.

19. An induction displacement unit, comprising:

an induction plenum in communication with a horizontal discharge plenum and a vertical discharge plenum;

a return air plenum;

a cooling coil disposed along a cooling air flow path extending from the return air plenum to the horizontal discharge plenum; and a heating coil disposed along a heating air flow path extending from the return air plenum to the vertical discharge plenum, wherein the cooling coil is positioned below the heating coil, and wherein the heating coil is configured to be actuated during a heating mode to heat an air flow that is directed along the heating air flow path.

20. The induction displacement unit of claim 19, comprising a water control valve of the heating coil, which is configured to be actuated by a controller to actuate the heating coil and adjust a flow rate of heating water through the heating coil.

21. The induction displacement unit of claim 19, wherein the induction plenum is in communication with the horizontal discharge plenum via a first nozzle, and wherein the induction plenum is in communication with the vertical discharge plenum via a second nozzle.

22. The induction displacement unit of claim 21, wherein the second nozzle is configured to provide a conditioned primary air flow from the induction plenum to the heating air flow path to induce the air flow into the return air plenum, along the heating air flow path, and out of a discharge grille of the induction displacement unit.

23. The induction displacement unit of claim 22, wherein the discharge grille is disposed in an upper portion of the induction displacement unit to enable the air flow to neutralize a cold perimeter load of a room.

24. The induction displacement unit of claim 19, wherein the cooling coil is configured to be actuated during a cooling mode to cool an air flow that is directed along the cooling air flow path.

25. The induction displacement unit of claim 19, wherein the induction displacement unit is configured to operate in a ventilation mode to provide a conditioned primary air flow from the induction plenum and to the horizontal discharge plenum, the vertical discharge plenum, or both.

* * * * *